United States Patent [19]

Oinonen

[11] Patent Number: 4,709,867

[45] Date of Patent: Dec. 1, 1987

[54] METHOD AND APPARATUS FOR REELING A WEB

[75] Inventor: Hannu U. Oinonen, Järvenpää, Finland

[73] Assignee: Oy Wartsila Oy, Finland

[21] Appl. No.: 890,734

[22] Filed: Jul. 30, 1986

[30] Foreign Application Priority Data

Aug. 6, 1985 [FI] Finland ..... 853019

[51] Int. Cl.[4] ..... B65H 18/20; B65H 19/28; B65H 19/30

[52] U.S. Cl. ..... 242/56 R; 242/66

[58] Field of Search ..... 242/55, 201, 202, 56 R, 242/58.1, 58.3, 58.6, 65, 66, 68.7

[56] References Cited

U.S. PATENT DOCUMENTS 3,841,578 10/1974 Dorfel ..... 242/66
3,918,654 11/1975 Okubo ..... 242/56 R
4,180,216 12/1979 Dahl ..... 242/66
4,580,740 4/1986 Fauser ..... 242/66
4,598,877 7/1986 Oinonen ..... 242/66

*Primary Examiner*—Donald Watkins
*Attorney, Agent, or Firm*—Steinberg & Raskin

[57] ABSTRACT

A web, such as a paper web, is reeled onto a core tube supported by first and second carrying rolls with a topside pressing roll pressing down on the web roll as it is being formed. The completed web roll is removed from the carrying rolls by at least two lowering rolls which are lifted along a path into engagement with the completed web roll, the lowering rolls contacting the web roll after being rotatably accelerated to have an appropriate surface speed. Substantially simultaneously with the completed web roll being lowered, a new core tube is inserted in the throat between the first and second carrying rolls. The web is cut, preferably without interrupting its movement, and the newly cut end of the web is affixed to the newly positioned core tube.

21 Claims, 8 Drawing Figures

METHOD AND APPARATUS FOR REELING A WEB

BACKGROUND OF THE INVENTION

The present invention relates generally to methods and apparatus for reeling a web.

In particular, the invention relates to a method for reeling a web wherein the web is reeled on a core tube which is supported by first and second carrying rolls with the web roll being pressed during formation by a topside pressing roll. The completed web roll is removed utilizing lowering means and substantially simultaneously with the lowering movement, a new core tube is introduced into the throat between the first and second carrying rolls. At this time, the web is cut, preferably without stopping its movement, and the newly cut end of the web is affixed to the new core tube.

Further, the invention relates to apparatus for reeling a web on a core tube comprising first and second carrying rolls and a pressing roll that presses down on the web roll as it is being formed on the core tube. The first and second carrying rolls define first and second nips with the web roll being formed. At least one of the carrying rolls is a driven roll adapted to rotate the core tube and web roll being formed therearound. A device is provided for cutting the web, preferably without stopping its movement, and affixing the newly cut end of the web to the core tube.

Upon completion of a web roll in web reeling operations, it becomes necessary to affix a new or newly cut end of a web to a new core tube. In such situations, it is generally necessary to stop the so-called tambour roll and, after changing the core tube or tubes, begin the rotation of the tambour roll again. Since tambour rolls are quite large and heavy, the braking of the rotation of the tambour roll, especially at the high reeling speeds presently being used which approach about 2000 m/min, causes undesirable wear on various structural components of the reeling apparatus and, additionally, a significant amount of time is required to bring the tambour roll to rest and then up to speed again. Presently, the time required for changing the core tubes is about 30 seconds in mechanized arrangements and about two minutes in the case where the core tubes are manually inserted. Moreover, restarting the large and heavy tambour rolls requires the consumption of relatively large amounts of electric energy.

An arrangement for reeling paper web or the like onto a reel core tube is disclosed in Finnish patent No. 63918. In particular, a reeler includes carrying rolls and a pressing roll for holding the web roll being formed against the carrying rolls. A device is disclosed in the Finnish patent for introducing a new reel core tube during the final stage of reeling of a web roll between that web roll and the carrying rolls. Also disclosed are web cutting means and a device for moving the completed web roll from between the carrying rolls and pressing roll. A device for guiding the cut end of the web so that it encircles the new core tube comprises guide means disposed on different sides of the reel core tube arranged to direct compressed air jets onto the web to guide the web around the core tube all the regions of the nips that interact with the core tube.

In Finnish patent No. 49276, a method is disclosed for reeling a web wherein the web is reeled onto a core tube which is supported by first and second carrying rolls with a topside pressing roll pressing down on the web roll being formed. After completion, the web roll is removed from the carrying rolls by lowering means and substantially simultaneously with the lowering movement, a new core tube is inserted into the throat between the first and second carrying rolls. The web is cut without stopping its movement and the newly cut end of the web is affixed to the core tube. Reeling of the web to form a new web roll begins at a position below the throat defined by the carrying rolls, the newly forming web roll being supported by an underside pressing roll, whereupon the new web is transferred, under the action of the underside pressing roll, through the throat between the carrying rolls which opens to permit such passage.

The main drawback of conventionl arrangements of the type described above is the inability to control the quality of the reeling operation to the extent desired. Problems have also been encountered in the lowering of the completed web roll. For example, the completed web roll is often damaged as it is being lowered.

SUMMARY OF THE INVENTION

One object of the present invention is to provide new and improved methods and apparatus for reeling a web.

Another object of the present invention is to provide new and improved web reeling methods and apparatus which enable the quality of the reeling operation to be controlled.

Still another object of the present invention is to provide new and improved methods and apparatus for reeling web wherein a completed web roll is lowered in a manner so as to avoid damage during this step.

A further object of the present invention is to provide new and improved methods and apparatus for reeling a web which eliminates the need to stop the large, heavy tambour roll, it only being necessary to slow its rotation during certain stages of the web changing operation, if desired.

A still further object of the present invention is to provide new and improved web reeling methods and apparatus which enable the initial reeling of the web onto the core tube to be carried out either above or below the throat defined between the carrying rolls.

Briefly, in accordance with the present invention, these and other objects are attained by providing an arrangement wherein the completed web roll is transferred to a lowering position by means of at least two lowering rolls in a manner such that the lowering rolls are lifted and moved along a path into engagement with the completed web roll and wherein prior to engaging the web roll, the lowering rolls are rotated to obtain appropriate surface velocity.

In one advantageous embodiment of the invention, as the completed web roll is being lowered, the first carrying roll is lifted slightly upwardly whereupon the completed roll moves to a position where it is supported by the lowering rolls and the second carrying roll. During this displacement, the completed roll is moved with the aid of the topside pressing roll until it rests on the lowering rolls. The lowering rolls are then fixed in a substantially horizontal plane whereupon the completed web roll is entirely supported by the lowering rolls. The topside pressing roll is moved so as to be situated closer to the first and second carrying rolls.

In another advantageous embodiment, the topside pressing roll is moved with a swinging motion along a curved path so that it continues to restrain the completed web roll which is supported by the lowering rolls until the completed roll has completely stopped. The topside pressing roll is thereafter moved back to its original position in a swinging motion along a curved path and in translatory movement to engage the new web roll as it is being formed.

In a third embodiment of the invention, the rolls are arranged such that the angle defined between a line passing through the axes of rotation of the carrying rolls and the horizontal is such that the center of gravity of the completed web roll lies on the side of the lowering rolls with respect to a vertical line passing through the axes of rotation of the second carrying roll. In this manner, when the pressing force of the topside pressing roll on the web roll is reduced, the completed web roll will descend to be supported by the lowering rolls.

In another embodiment of the invention, the lowering rolls are moved along a curved path from positions laterally outside of the carrying rolls to support the completed web roll whereupon the completed roll is then lifted by the lowering rolls out of contact with the carrying rolls.

Upon the lowering rolls coming substantially to rest, the completed web roll is transported by pusher means to means for receiving and further carrying the completed web roll.

Apparatus in accordance with the invention also includes web cut-off and blowing means for interrupting the web, these means being movable into operating position by displacement means. Substantially simultaneously with web interruption, a new core tube is moved by means of an underside pressing roll into position against the carrying rolls and into the throat between the carrying rolls. Alternatively, the new core tube may be transported into the throat between the carrying rolls over an upper or topside path with its ends being supported and from the direction of the side of the apparatus at which the second carrying roll is located.

The methods and apparatus of the invention provides several significant advantages. In particular, the invention makes it possible to control the web reeling operation in a reliable manner to ensure that excellent web quality, as well as reeling quality can be maintained. The lowering of the completed web roll takes place in a manner that ensures that damage to the completed web roll is avoided. The time required to change a web roll is significantly reduced since it is not necessary to stop or even reduce the speed of the large, heavy tambour roll. This feature makes it possible, if desired, to run the web directly from the paper machine into the reeling apparatus. The invention also enables the reeling of the web to be initiated either above or below the throat between the carrying rolls. The quality of the reeled-up web will also be improved since a slightly lower reeling speed can be used due to the continuous operation of apparatus in accordance with the invention which has the effect of reducing harmful air currents and the like during the reeling operation. The quantity of broke will also be reduced since it is no longer necessary to reel the web on the tambour roll at the beginning of the reeling operation. Furthermore, a reeling operation in accordance with the invention requires less machinery, and less personnel to operate the machinery, thereby significantly reducing costs.

DESCRIPTION OF THE DRAWINGS

A more complete appreciation of the present invention and many of the attendant advantages thererof will be readily understood by reference to the following detailed description when considered in connection with the accompanying drawings in which.

DESCRIPTION OF THE PREFERRED EMBODIMENTS

Figure 1:
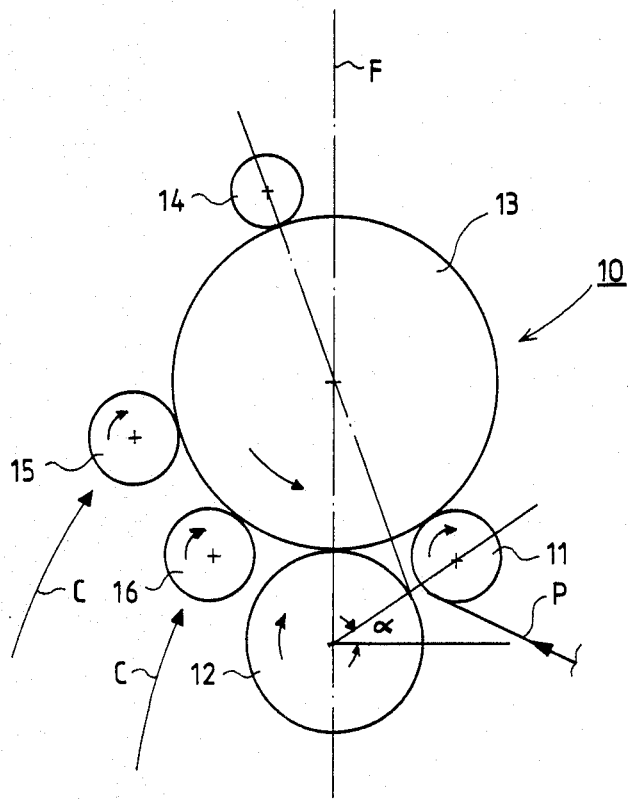
FIG. 1 is a schematic elevation view of apparatus for reeling a web in accordance with a method of the invention, and illustrating the lowering rolls after elevation to upper positions to receive the completed web roll.

Reference will now be made to the drawings wherein like reference characters designate identical or corresponding parts through the several view, and more particularly to FIGS. 1–7 which illustrate a first embodiment of apparatus in accordance with the invention. The apparatus, generally designated 10, comprises a first carrying roll 11 and a second carrying roll 12. The web P is reeled through the space or throat between the carrying rolls onto a core tube 20 (FIGS. 4,5, and 6) whereupon the web eventually forms a completed web roll 13. The apparatus 10 further includes a topside pressing roll 14 and lowering rolls 15 and 16. Moving means 17 (FIGS. 4–6) are provided for displacing the web-interrupting and blowing means 18. In this embodiment, moving means 17 are disposed on the shaft of the first carrying roll 11.

Figure 4:
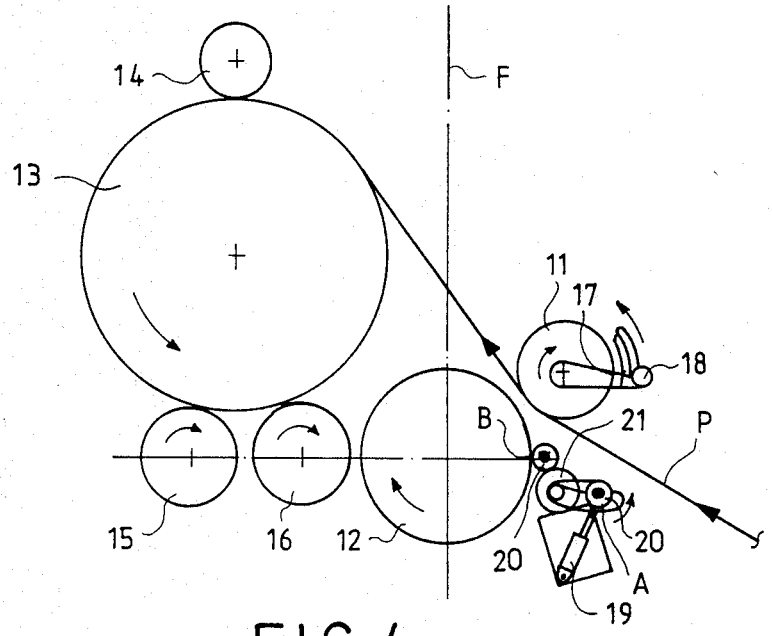
FIG. 4 is a schematic elevation view of the apparatus of FIG. 1 and illustrating a stage of the operation in which substantially simultaneously with the lowering of the completed web roll, the reeling shaft and its core tube is introduced below the throat defined between the carrying rolls.

Apparatus 10 further comprises a core tube inserter 19 (FIGS. 4–7) disposed below the throat between the carrying rolls 11 and 12 and arranged to move the reeling shaft with its core tube 20 from the position A (FIG. 4) to the position B (FIG. 4). Finally, apparatus 10 includes an underside pressing roll 21 (FIGS. 4–7) which in the illustrated embodiment is located such that the core tube inserter 19 is arranged to undergo a swinging movement around the axes of the lowering pressing roll 21.

Apparatus 10 operates in the following manner. Referring to FIG. 1, the lowering rolls 15 and 16 ascend along respective paths C, which are preferably curved, to the positions illustrated in the figure at which they engage the completed web roll 13. Prior to engagement, the lowering rolls 15 and 16 are rotated until their surface velocity is substantially equal to the surface velocity of the rotating web roll 13. The lowering rolls 15 and 16 are preferably coated with rubber or the like. Prior to engagement by the lowering rolls, the web roll being formed is supported by the first and second carrying rolls 11 and 12.

Figure 2:
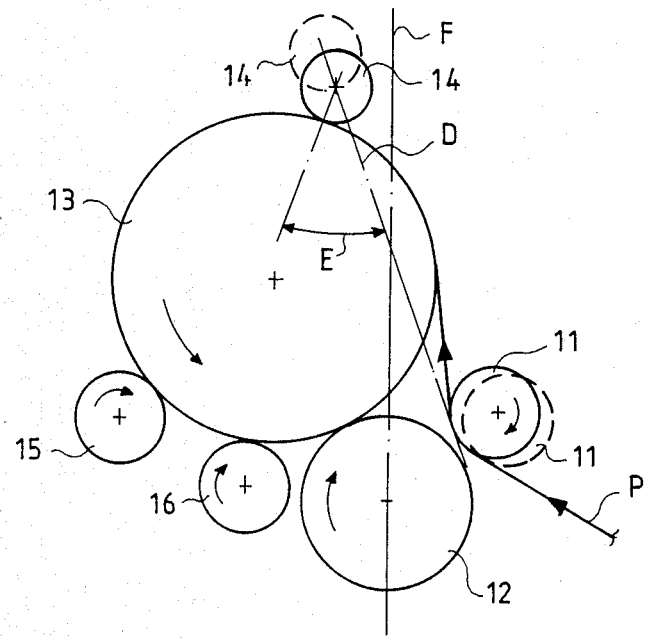
FIG. 2 is a schematic elevation view of the apparatus illustrated in FIG. 1, and illustrating a stage of the operation in which the first carrying roll has somewhat ascended and in which the completed web roll has moved to become supported by one of the lowering rolls and by the second carrying rolls.

Referring to FIG. 2, after the lowering rolls 15 and 16 engage the completed web roll 13, the first carrying roll 11 is elevated a small distance out of engagement with web roll 13 whereupon the web roll 13 moves to a position where it is supported by the lowering rolls 15 and 16 and by the second carrying roll 12. The topside pressing roll 14 is arranged to follow along with the web roll 13 as the web roll moves to the position shown in FIG. 2. The topside pressing roll 14 moves along a substantially rectilinear path D until the web roll 13 comes to rest supported by the lowering rolls 15 and 16.

Figure 3:
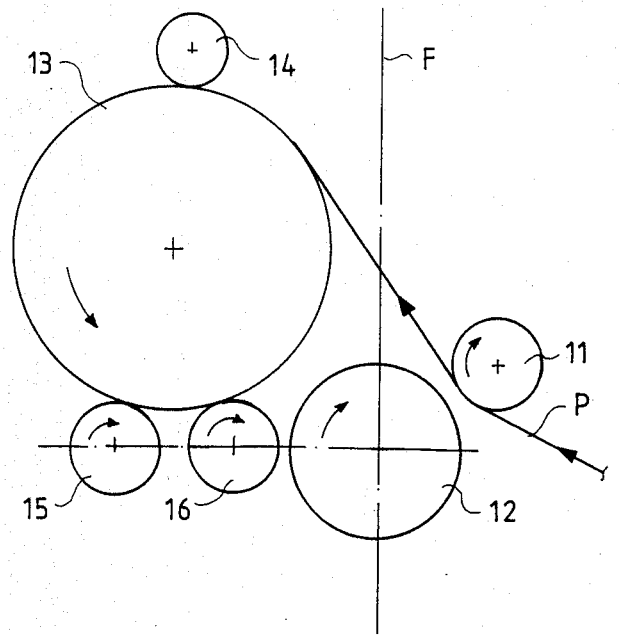
FIG. 3 is a schematic elevation view of the apparatus illustrated in FIG. 1 and illustrating a stage of the operation in which the lowering rolls have come to rest in a substantially horizontal plane.

Referring to FIG. 3, the lowering rolls 15 and 16 continue their movement from the positions shown in FIG. 2 until the positions shown in FIG. 3 are reached whereupon the lowering rolls 15 and 16 cease movement. As seen in FIG. 3, the axes of rotation of lowering rolls 15 and 16 are situated in a substantially horizontal plane and the completed web roll 13 is supported in its entirety by the lowering rolls 15 and 16. The topside pressing roll 14 has moved from the position shown in FIG. 2 to the position shown in FIG. 3.

Referring to FIG. 4, at substantially the same time as the web roll 13 is lowered, the core tube inserter 19 moves a reeling shaft with a core tube 20 from the position designated A to the position designated B over the underside pressing roll 21.

Figure 5:
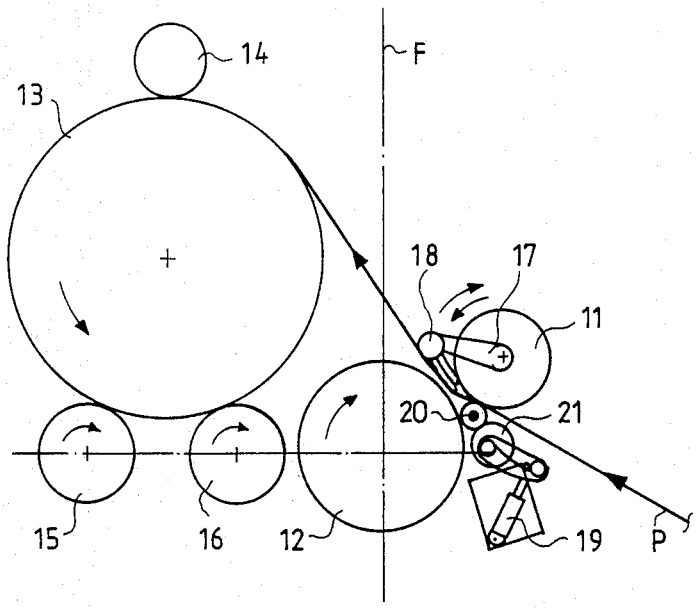
FIG. 5 is a schematic elevation view of the apparatus illustrated in FIG. 1 and illustrating a stage of the operation in which immediately after the lowering motion of the completed web roll has ceased, the cut-off means interrupts the web and the core tube shaft ascends under the effect of an underside pressing roll into position against the carrying rolls.

Referring to FIG. 5, as soon as the lowering motion of the web roll 13 ceases, the moving means 17 moves the web-interrupting and blowing means 18 into the position shown in FIG. 5. At the same time, the underside pressing roll 21 transports the core tube 20 to a position where it engages the carrying rolls 11 and 12. Engagement of the core tube 20 with the nip defined between carrying rolls 11 and 12, the interruption of the web P and the directing of the cut end of the web by means of air jets from blowing means 18 occur substantially simultaneously. Immediately after interruption of web P, the lowering rolls 15 and 16 begin to brake the rotation of the completed web roll 13, which is being restrained by the topside pressing roll 14, whereupon the rotation of web roll 13 is completely terminated.

Figure 6:
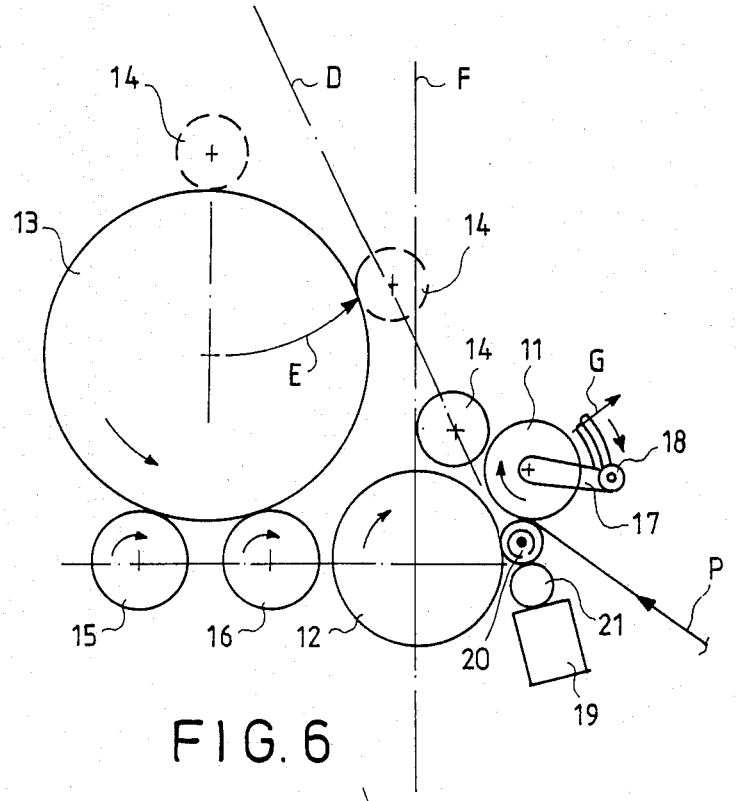
FIG. 6 is a schematic elevation view of the apparatus illustrated in FIG. 1 and illustrating a stage of the operation in which the new web roll is reeled from below the throat between the carrying rolls supported by the underside pressing roll and with the topside pressing roll descended into its lower position and with the first carrying roll moved away from the second carrying roll.

Referring to FIG. 6, the reeling of the incoming web P onto the new core tube 20 begins to begin the formation of a new web roll below the throat defined by the carrying rolls 11 and 12 and supported by the underside pressing roll 21. The topside pressing roll 14 has descended into its lower position and the first carrying roll 11 begins to move away from the second carrying roll 12 in the direction of arrow G. The moving means 17 returns the interrupting and blowing means 18 from the position of FIG. 5 to its inactive position shown in FIG. 6.

Figure 7:
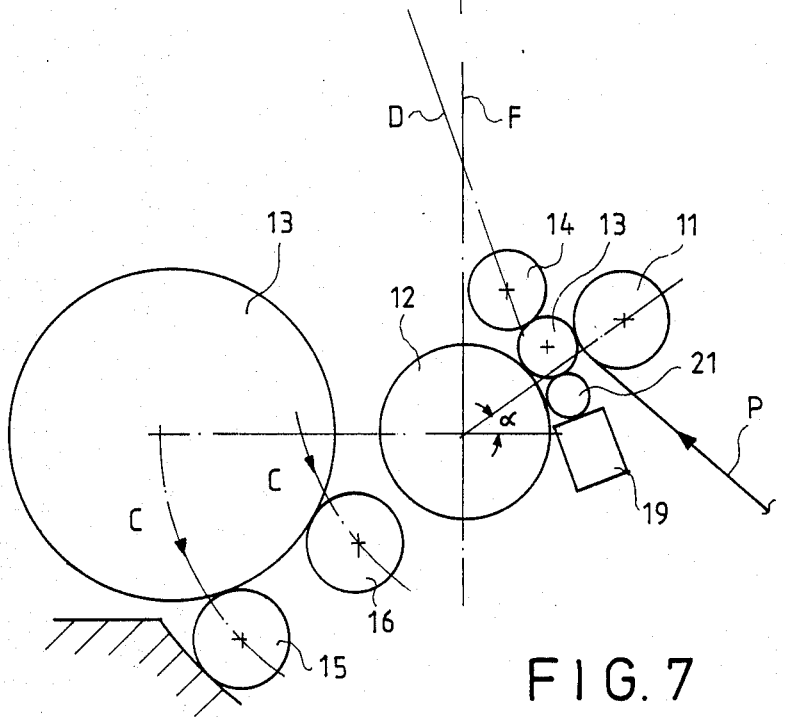
FIG. 7 is a schematic elevation view of the apparatus illiustrated in FIG. 1 and illustrating a stage of the operation in which the underside pressing roll transports the web roll through the throat between the carrying rolls which has opened or widened.

Referring to FIG. 7, the underside pressing roll 21 begins to move the newly forming web roll 13' upwardly to the opened roll throat between carrying rolls 11 and 12. After the web roll 13' is moved through the roll throat, the newly formed web roll 13' continues to reel the web P in the conventional manner supported by carrying rolls 11 and 12 and topside pressing roll 14.

In the embodiment of the invention described above, the web-interrupting and blowing means 18 are operatively connected through moving means 17 to the carrying roll 11. However, it will be understood that means 18 provided separately from the other equipment are within the scope of the invention. Similarly, moving means 17 for the web-interrupting and blowing means 18 may have other forms than that illustrated. Similarly, other designs for the core tube inserter 19 may be utilized.

The lowering of the completed web roll 13 is preferably accomplished by the swinging of the pressing roll 14 along a curved path E as shown in FIG. 2 whereupon the pressing roll 14 remains in a position to restrain the completed web roll 13 as it rotates supported by lowering rolls 15 and 16. When rotation of the completed web roll 13 is terminated, the pressing roll 14 restrains the web roll 13 until it is completely stationary whereupon the pressing roll 14 is transferred to the position shown in FIG. 6 in preparation for receiving the new web roll 13'.

It is not absolutely necessary to elevate the first carrying roll 11 as shown in FIG. 2 in order to initiate the lowering of the completed web roll 13 into engagement with the lowering rolls 15 and 16. Alternatively, the angle defined between a line conncecting the axes of rotation of the carrying rolls 11 and 12 and the horizontal can be selected so that the center of gravity of the completed web roll 13 will always lie on the left side (as seen in FIG. 1) of the vertical F that passes through the axis of rotation of the second carrying roll 12. In this manner, when the depressing force of the topside pressing roll 14 is reduced, the completed web roll 13 will automatically descend under gravity forces into engagement with the lowering rolls 15 and 16. This arrangement is advantageous with respect to controlling the quality of reeling.

Figure 8:
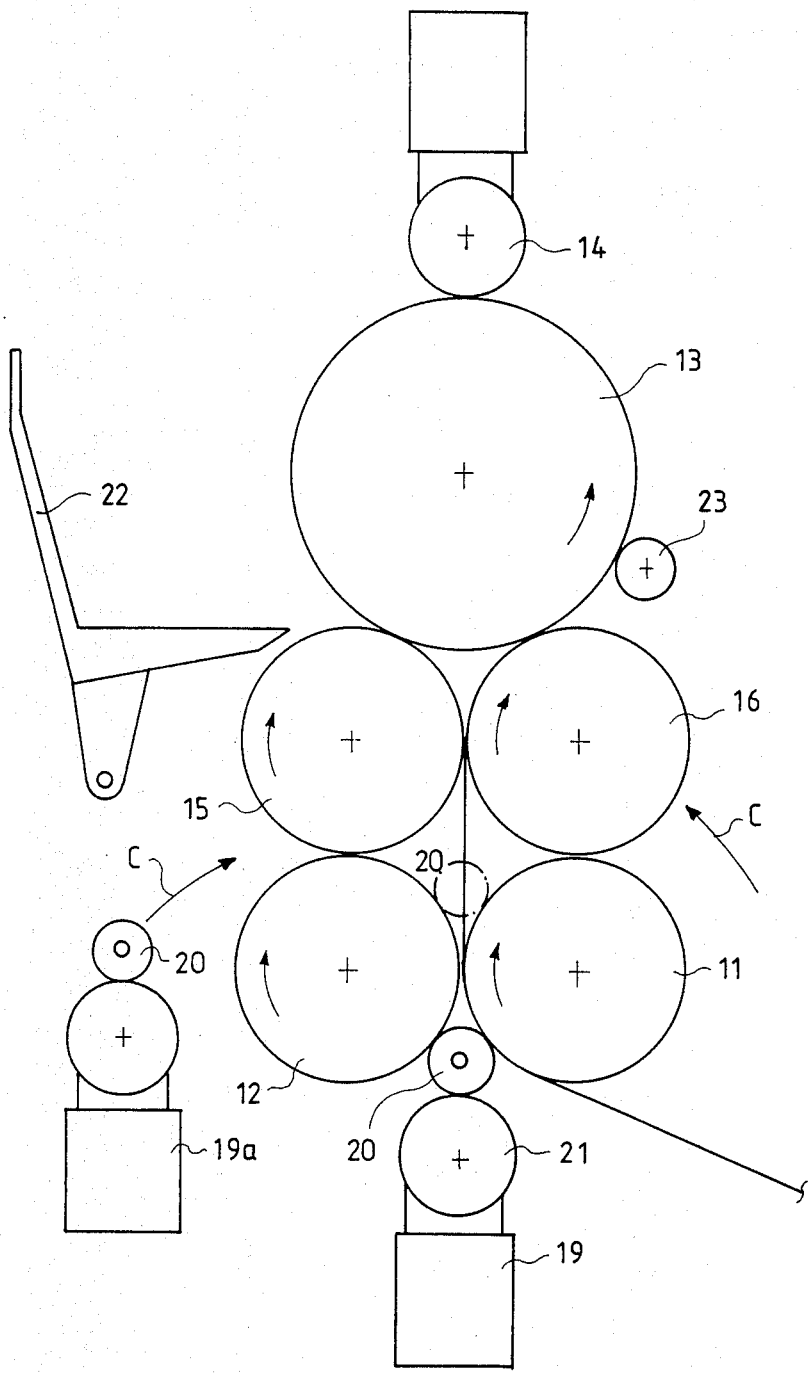
FIG. 8 is a schematic elevation view of another embodiment of apparatus in accordance with the invention.

Referring to FIG. 8, a second embodiment of apparatus in accordance with the invention is illustrated. In this embodiment, the lowering rolls 15 and 16 are moved along respective curved paths C from initial positions laterally outwardly of the carrying rolls 11 and 12 to support the completed web roll 13. Subsequently, the lowering rolls 15 and 16 are elevated to dissengage the completed web roll 13 from the carrying rolls 11 and 12. When the lowering rolls 15 and 16 have stopped rotating, pressure means 23 are operated to move the completed web roll 13 onto receiving and supporting means 22. A new core tube 20 is moved into the throat between the carrying rolls 11 and 12 in topside conduction and with end support from the direction of the second carrying roll 12. The core tube inserter in accordance with the illustrated embodiment is designated 19*a*. In other respects, the embodiment of the invention shown in FIG. 8 coresponds to that illustrated in FIGS. 1–7.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for reeling a web, comprising the steps of:

feeding a web onto a web roll being formed while supporting the web roll being formed on first and second carrying rolls with a topside pressing roll pressing down with a pressing force on the web roll being formed;

accelerating rotation of at least two lowering rolls situated below said web roll until said lowering rolls rotate with an appropriate surface velocity;

upon substantial completion of said web roll, elevating said lowering rolls along respective movement paths into engagement with said completed web roll;

interrupting the web to provide a cut-off end of the web;

lowering said completed web roll by lowering said lowering rolls;

at substantially the same time as said completed web roll is being lowered, inserting a new core tube in a throat defined between said first and second carrying rolls; and affixing the cut-off end of the web to the new core tube to initiate formation of a new web roll.

2. The method of claim 1 wherein said step of interrupting the web to provide a cut-off end is accomplished without stopping the web feed.

3. The method of claim 1 wherein during said step of lowering said completed roll, at leat slightly elevating said first carrying roll whereby said completed web roll moves to a position at which it is supported by said lowering rolls and by said second carrying roll, and moving said topside pressing roll to urge said completed web roll to a position at which it is entirely supported by said lowering rolls.

4. The method of claim 1 wherein said step of lowering said lowering rolls terminates upon said lowering rolls reaching positions at which their axes of rotation are substantially situated in a horizontal plane whereby said completed web roll is entirely supported by said lowering rolls.

5. The method of claim 4 wherein during said lowering step, moving said topside pressing roll towards the first and second carrying rolls.

6. The method of claim 1 further including the step of, after elevating said lowering rolls into engagement with said completed web roll, moving said topside pressing roll in a swinging motion along a curved path so that said topside pressing roll continues to restrain said completed web roll as it rotates supported by said lowering rolls and until rotation of said completed web roll terminates, and moving said topside pressing roll to a position where it engages the new web roll being formed.

7. The method of claim 1 further including the steps of arranging said carrying rolls such that an angle formed by a straight line passing through the axes of rotation of said first and second carrying rolls and the horizontal is such that the center of gravity of said completed web roll lies on the sideof said lowering rolls with respect to a vertical passing through the axes of rotation of said second carrying roll, and reducing the pressing force at which said topside pressing roll presses down on said web roll whereby said completed web roll automatically descends under the force of gravity into engagement with said pair of lowering rolls.

8. The method of claim 1 wherein prior to elevating said lowering rolls, said lowering rolls are situated below and laterally outwardly of said carrying rolls, moving said lowering rolls along respective curved paths from below and outwardly of said carrying rolls into supporting engagement with said completed web roll, said lowering rolls elevating said completed web roll out of engagement with said carrying rolls, substantially stopping rotation of said lowering rolls, and pushing said completed web roll to receiving and supporting means for the completed roll.

9. The method of claim 1 wherein said step of interrupting the web comprises providing web-interrupting and air blowing means and moving said web-interrupting and blowing means into operating position utilizing displacing means.

10. The method of claim 1 wherein said step of inserting a new core tube is performed substantially simultaneously with the step of interrupting the web, and includes moving an underside pressing roll against new core tube.

11. The method of claim 1 wherein said step of inserting a new core tube in the throat defined between said carrying rolls comprises moving the new core tube from the direction of said second carrying rolls in topside conduction and with its ends supported.

12. Apparatus for reeling a web onto a core tube to form a web roll, comprising:

a first carrying roll for forming a first nip with the web roll;

a second carrying roll for forming a second nip with the web roll;

said first and second carrying rolls supporting the web roll being formed;

a pressing roll for pressing against the web roll;

interrupting and affixing means for interrupting the web upon substantial completion of a web roll to provide a cut-off end of the web and for affixing the cut-off web end to a new core tube; and at least two lowering rolls situated below said web roll being formed and arranged to move upwardly into engagement with the web roll upon substantial completion thereof to support and lower said completed web roll.

13. The apparatus of claim 12 further including means for accelerating the rotation of said lowering rolls to obtain an appropriate surface velocity prior to said lowering rolls engaging said web roll.

14. The apparatus of claim 12 wherein at least one of said carrying rolls comprises driven carrying roll means for rotating the core tube and the web roll being reeled thereupon.

15. The apparatus of claim 12 wherein said web interrupting means operates without stopping the web.

16. The apparatus of claim 12 wherein said lowering rolls are coated with rubber or the like.

17. The apparatus of claim 12 wherein said means for affixing the cut-off end of the web to a new core tube includes blow means for directing gas jets against the cut-off web end and causing said cut-off web end to adhere to a new core tube.

18. The apparatus of claim 12 wherein said interrupting and affixing means are movable between a first inoperative position and a second operative position and further including moving means for moving said interrupting and affixing means between said first and second positions.

19. The apparatus of claim 18 wherein said moving means are rotatably mounted on said first carrying roll.

20. The apparatus of claim 12 further including core tube inserter means for transporting a new core tube into a throat defined between said first and second carrying rolls from below said carrying rolls, and an underside pressing roll for supporting the new core tube.

21. The combination of claim 12 further including core tube inserter means for transporting a new core tube into a throat defined between said first and second carrying rolls from above said carrying rolls from the direction of said second carrying roll.

* * * * *